United States Patent [19]

McDonald

[11] 4,214,346

[45] Jul. 29, 1980

[54] BRUSH STICK

[75] Inventor: George K. McDonald, P.O. Drawer E, Lamesa, Tex. 79331

[73] Assignee: George K. McDonald, Lamesa, Tex.

[21] Appl. No.: 972,672

[22] Filed: Dec. 26, 1978

[51] Int. Cl.[2] ..... D01B 1/06

[52] U.S. Cl. ..... 19/60; 15/183

[58] Field of Search ..... 19/60; 15/183, 193, 15/195, 199

[56] References Cited

U.S. PATENT DOCUMENTS

| | | | |
|---|---|---|---|
| 2,450,679 | 10/1948 | May | 19/60 |
| 3,120,671 | 2/1964 | Miller | 15/193 X |
| 3,225,389 | 12/1965 | Jones | 19/60 |
| 3,425,084 | 2/1969 | St. Laurence et al. | 15/195 |

*Primary Examiner*—Louis Rimrodt

*Attorney, Agent, or Firm*—Wendell Coffee

[57] ABSTRACT

A brush stick for cotton gins is made of a expanded, rigid thermoplastic having closed cells on the interior and a dense, non-cellular skin. The stick is mounted on a cylinder and is used to doff cotton from a saw cylinder.

5 Claims, 3 Drawing Figures

BRUSH STICK

BACKGROUND OF THE INVENTION (1) Field of the Invention

This invention relates to processing fibrous materials and more particularly to a brush for doffing cotton from a saw cylinder.

(2) Description of the Prior Art

In ginning cotton it is well known and the usual practice to snag the cotton upon a saw cylinder for processing and then doff the cotton from the cylinder. This process occurs typically three times in the processing of the cotton. First, the cotton is picked up a lock at a time in the early processing stages of the cotton gin to clean sticks, burrs, dirt and trash from the cotton. This is done by beating the cotton against bars. After this process the cotton is doffed by a brush cylinder by rotating at higher speed.

Thereafter in the ginning process itself, locks of cotton are picked up by the saw cylinder and then the fiber pulled through ribs which prevent the seed from going through the ribs and then the cotton doffed from the saw cylinder. Although the cotton is sometimes doffed by an air blast, it is also often doffed by a brush.

Thereafter often the cotton lint itself is picked up by a saw cylinder for lint cleaning process wherein the cotton is beat against mote bars to remove dust and trash from the lint, then it is doffed by brushes.

The brushes are mounted upon sticks. In the prior art these sticks are made of wood such as birch or hardwood. Sometimes the sticks are made from laminated wood. Holes are drilled for the individual tuffs or bundles of the fiber which are then glued and stapled in place. The bristles are natural bristles. The two most popular bristles being horsehair bristles or Tampico fiber. The Tampico Fiber is a plant fiber. The most common plant fiber used is known in the trade as "Black Patent Tampico".

The saw cylinders themselves rotate at high speed and for doffing it is necessary that the brushes move faster than the surface of the saw cylinder. Therefore, the brush cylinders turn at very high speed. It is necessary that they be balanced. With natural woods, it is extremely difficult to get the brush sticks to be of equal weight and, therefore, there is always a balancing problem. Also, in recent years there has been a greater problem in obtaining natural wood for these sticks which does not warp badly. In short, in modern practice it is difficult to find wood suitable for use in high speed precision machinery.

Another serious problem that exists in the cotton gin is that of static electricity. Many synthetic materials have a high production of static electricity. This is the main reason why natural fibers are used in the brushes rather than synthetic fibers. Also, it may have been in the prior art that the wood brush sticks were thought to be necessary to prevent an excess of static electricity.

SUMMARY OF THE INVENTION (1) New and Different Function

I have discovered that a superior brush stick may be made from a expanded, rigid, closed cell thermoplastic. Such expanded, rigid thermoplastics have previously been used in the furniture industry as a substitute for wood. Although the interior of the structural members have a closed cell structure the skin is dense and hard without having a cellular stucture. This material is lighter in weight which is desirable. But more important, the weight is uniform. I.e., each stick is very nearly identical to each and every other stick. There is no warping or cracking problem involved. Also, I have found that static electricity is not increased by the use of the synthetic stick.

The structural styrofoam material is processed the same as wood. I.e., the same type machinery is used to drill holes in the synthetic stick and the natural bristles are glued and stapled in place using the exact same machines as are used in making wooden brush sticks.

Therefore it may be seen that the total function of my invention far exceeds the sum of the individual functions of the bristles, staples, etc.

(2) Objects of this Invention

An object of this invention is to doff cotton from a cylinder.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 1:
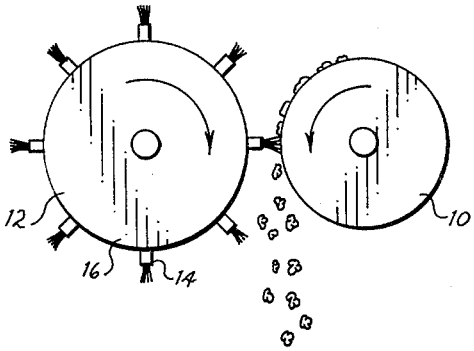
FIG. 1 is a schematic representation of typical cotton processing equipment.

Referring to FIG. 1, there may be seen a first cylinder 10 with cotton on the surfact thereof. As discussed above, this first cylinder 10 would typically be a saw cylinder with either locks of cotton or lint cotton thereon. As stated above, cylinders with cotton on the surface thereof have been in common use in cotton gins for many years. The first cylinder 10 rotates in the direction indicated by the arrow. Adjacent thereto is doffing cylinder 12. The doffing cylinder 12 rotates in the direction shown by the arrow thereon. The doffing cylinder 12 rotates so that the surface speed of the doffing cylinder is faster than the surface speed of the first cylinder 10. As schematically represented in FIG. 1 the doffing cylinders have a series of brush sticks 14 mounted to the surface 16 thereof.

Figure 2:
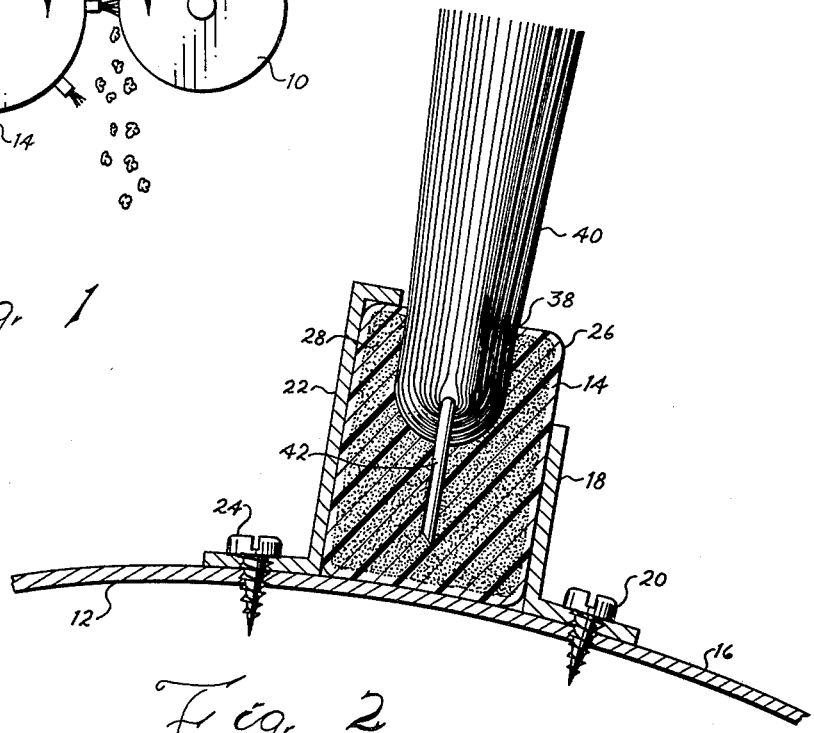
FIG. 2 is a cross sectional view of a brush according to this invention mounted upon a cylinder.

FIG. 2 shows the mounting of a typical brush stick to the surface 16 of the doffing cylinder 12. As shown, typically an angle iron backing plate 18 is attached by metal screw 20 to the surface 16 which is in the form of a metal sheet. A Z-shaped bracket 22 likewise held by metal screw 24 holds the other side firmly against the surface 16 and also a top lip on the bracket 22 holds the stick 14 down. It will be understood that the equipment described to this point is old and well known with the use of wooden brush sticks.

According to this invention a brush stick made of expanded, rigid thermoplastic having closed cells is used for the brush stick 14. A structural polystyrene as used in the furniture industry is well suited for the synthetic stick. As shown, the stick 14 will have a skin 26 which is non-cellular, i.e., it is dense and forms a hard outer surface. The interior 28 will have the cellular structure or generally called "blown" interior. The cells will be closed cells.

Figure 3:
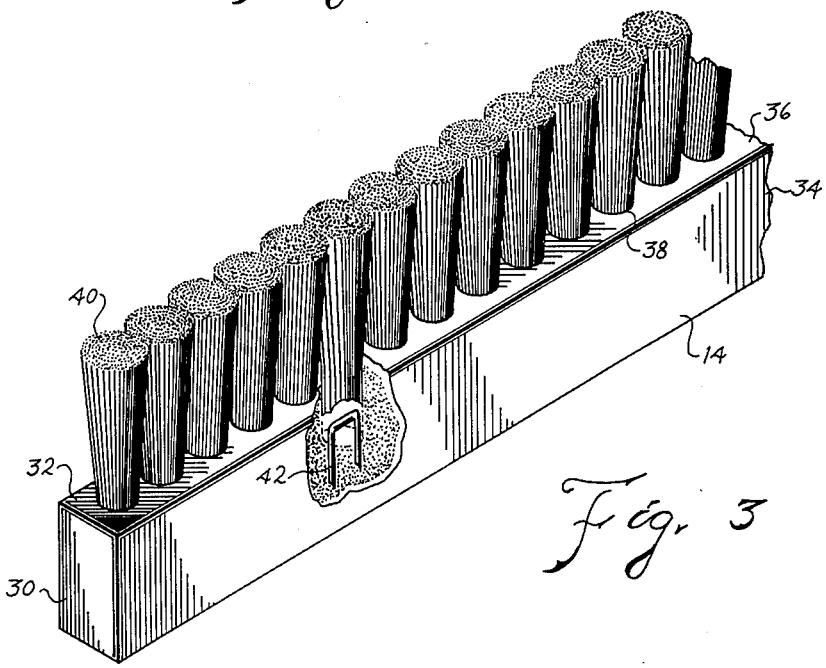
FIG. 3 is a perspective view of a portion of a brush according to this invention with portions broken away to illustrate construction.

It may be seen referring to FIG. 3 that the stick has a rectangular cross section with a height 30 and a width 32. The brush would have a length 34 which is several times the width or it is also the length could be several times the height and width combined. Along the face or the top face would be the width side of the rectangular cross section. In this width face a series of holes 38 are formed. These holes are formed with conventional drilling equipment as would be used for drilling the wood. These holes 38 are filled with natural bristle 40, either horsehair or Tampico according to the desires of the purchaser. The bristles 40 have a slight amount of glue or cement upon them to glue them into the holes and are held securely in place by staple 42 as is customary with brush sticks.

As an aid to correlating the terms of the claims to the exemplary drawing, the following catalog of elements is provided:

| | |
|---|---|
| 10 first cylinder | 28 interior |
| 12 doffing cylinder | 30 height |
| 14 brush stick | 32 width |
| 16 surface | 34 length |
| 18 angle back | 36 top face |
| 20 metal screw | 38 hole |
| 22 bracket | 40 bristle |
| 24 metal screw | 42 staple |
| 26 skin | |

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. In cotton processing equipment having a. a first cylinder with cotton on the surface thereof, and b. a doffing cylinder adjacent the first cylinder; an improved elongated brush on the doffing cylinder comprising:

c. a stick made of expanded rigid thermoplastic having closed cells on the interior and a dense non-cellular skin, d. the stick having a rectangular cross section of a width and height, and e. a length several times the height, and f. a series of holes in the width side along the length, and g. natural bristles in the holes.

2. The invention as defined in claim 1 further comprising:

h. glue in the holes between the bristles and thermoplastic, and j. a staple driven into the thermoplastic holding the bristles in place.

3. The invention as defined in claim 1 further comprising:

h. said thermoplastic being structural polystyrene.

4. The invention as defined in claim 1 further comprising:

h. said thermoplastic being structural polystyrene, and j. said bristles selected from a group consisting of horsehair and Tampico.

5. The invention as defined in claim 4 further comprising:

k. glue in the holes between the bristles and polystyrene, and m. a staple driven into the polystyrene holding the bristles in place.

* * * * *